US008195057B2

(12) United States Patent
Hachisuka

(10) Patent No.: US 8,195,057 B2
(45) Date of Patent: Jun. 5, 2012

(54) IMAGE FORMING APPARATUS AND FIXING DEVICE USED THEREIN

(75) Inventor: Toshiharu Hachisuka, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 311 days.

(21) Appl. No.: 12/539,715

(22) Filed: Aug. 12, 2009

(65) Prior Publication Data

US 2010/0046973 A1 Feb. 25, 2010

(30) Foreign Application Priority Data

Aug. 21, 2008 (JP) ..... 2008-212390

(51) Int. Cl.
*G03G 15/20* (2006.01)

(52) U.S. Cl. ..... 399/69; 399/67

(58) Field of Classification Search ..... 399/33, 399/67–69, 122, 320
See application file for complete search history.

(56) References Cited

U.S. PATENT DOCUMENTS

| | | | | |
|---|---|---|---|---|
| 5,740,513 | A * | 4/1998 | Matsuo et al. | 399/333 |
| 5,838,590 | A * | 11/1998 | Shimoyama et al. | 702/130 |
| 6,405,002 | B2 | 6/2002 | Ogiyama et al. | |
| 6,577,840 | B2 * | 6/2003 | Hachisuka et al. | 399/329 |
| 6,847,792 | B2 * | 1/2005 | Nakafuji et al. | 399/69 |
| 6,865,363 | B2 | 3/2005 | Hachisuka et al. | |
| 7,127,204 | B2 | 10/2006 | Satoh et al. | |
| 7,313,353 | B2 | 12/2007 | Satoh et al. | |
| 2004/0245235 | A1 * | 12/2004 | Kishi et al. | 219/216 |
| 2006/0127119 | A1 * | 6/2006 | Sato | 399/69 |
| 2006/0263122 | A1 | 11/2006 | Hachisuka | |
| 2008/0253789 | A1 | 10/2008 | Yoshinaga et al. | |
| 2009/0016760 | A1 | 1/2009 | Hachisuka | |
| 2009/0169232 | A1 | 7/2009 | Kunii et al. | |
| 2010/0104298 | A1 * | 4/2010 | Hachisuka | 399/33 |
| 2010/0254726 | A1 * | 10/2010 | Endo | 399/69 |

FOREIGN PATENT DOCUMENTS

| | | |
|---|---|---|
| JP | 2000-75707 | 3/2000 |
| JP | 2004-102104 | 4/2004 |
| JP | 2005-37539 | 2/2005 |
| JP | 2006-119430 | 5/2006 |
| JP | 2006-227374 | 8/2006 |
| JP | 2007-121329 | 5/2007 |

* cited by examiner

*Primary Examiner* — David Porta
*Assistant Examiner* — Casey Bryant
(74) *Attorney, Agent, or Firm* — Oblon, Spivak, McClelland, Maier & Neustadt, L.L.P.

(57) ABSTRACT

An image forming apparatus includes an image carrier on which a toner image is formed, a transfer unit to transfer the toner image from the image carrier onto a recording medium, a fixing device to fix the toner image on the recording medium, and a cooling device to cool a heating member of the fixing device. The fixing device includes a pressure member to apply pressure to the toner image on the recording medium, the heating member to heat the toner image on the recording medium, a heating device to heat the heating member, and a first power supply to supply power to the heating device. The cooling device is supplied with power by a second power supply separate from the first power supply.

10 Claims, 4 Drawing Sheets

IMAGE FORMING APPARATUS AND FIXING DEVICE USED THEREIN

CROSS-REFERENCE TO RELATED APPLICATION

This application claims priority from Japanese patent application No. 2008-212390, filed on Aug. 21, 2008 in the Japan Patent Office, which is hereby incorporated by reference herein in its entirety.

BACKGROUND OF THE INVENTION

1. Field of the Invention

The present invention relates to an image forming apparatus such as a copier, a printer, a facsimile machine, and a complex machine having the functions of these apparatuses, and a fixing device provided in the image forming apparatus.

2. Discussion of the Background Arts

In general, electrophotographic image forming apparatuses, such as copiers, printers, facsimile machines, or multifunction devices including at least two of those functions, include an image forming unit to form an image on an image carrier, a transfer unit to transfer the image from the image carrier onto a sheet of recording media, and a fixing device to fix the image on the sheet.

The fixing device is a mechanism that typically includes a pressure member, a heating member such as a heating roller, and a heater, such as halogen heater or an electromagnetic induction heating device, to heat the heating member. The image on the sheet is fixed with the heat from the heating member as well as the pressure from the pressure member where the pressure member presses against the heating member via the fixing member. Alternatively, the image may be fixed where the pressure member presses against a fixing belt that is heated by the heating roller.

It is known that the temperature of the heating member in the fixing device sharply rises after printing is completed. More specifically, during printing, that is, while the recording medium is being transported through the fixing device, because the recording medium draws heat from the heating member via the fixing member, the temperature of the heating member does not increase sharply.

By contrast, immediately after printing is completed, because the heat transfer to the recording medium suddenly stops, the temperature of the heating member can increase sharply due to, for example, the heat accumulated in a metal core of the heating member and so forth.

Because such an increase in the temperature of the heating member can be detected as an abnormal state, for example, in a known approach, it is avoided that such a temperature increase is detected as an abnormal state as follows: When the temperature of the heating member increases after printing is completed, the threshold value for detecting an sharply high temperature after a predetermined time has lapsed after the power-on is set to a relatively high temperature so that the temperature of a fixing roller after the power-on is not detected as abnormal.

However, if the temperature of the heating member increases significantly, it is not desirable because it can thermally damage the fixing device. This sharp increase in temperature is a phenomenon called "overshoot" of the heating member that occurs after printing is completed.

In particular, overshoot tends to occur immediately after completion of continuous printing. In addition, the higher the printing speed or CPM (Copies Per Minute) of the image forming apparatus, or the greater the weight per square of the recording medium, the more likely overshoot is to occur.

In view of the foregoing, various approaches described below have been advanced.

In known fixing devices, to prevent overshoot of the heating member after printing is completed, the temperature of the heating member is detected in a non-sheet area, where no recording medium contacts, after continuous printing is completed, and a cooling device to cool the heating member is operated when the detected temperature exceeds a predetermined temperature.

However, the known fixing devices described above have a drawback in that overshoot of the heating member can still occur in certain situations, such as when a main switch of the image forming apparatus is turned off during or immediately after printing is completed, when the conveyance of the recording medium is stopped (e.g., paper jamming occurs) during printing, or when the power supply to the image forming apparatus is stopped due to a power failure during or immediately after printing is completed.

If overshoot of the heating member occurs after or during printing, it is possible that a component constituting the fixing device may be thermally damaged. In particular, in an image forming apparatus whose printing speed is relatively high (e.g., approximately 75 CPM) and including a fixing device in which a fixing belt is stretched over a heating member such as a heating roller, the temperature of the fixing belt can rise to approximately 270 degrees Celsius due to overshoot of the heating member, at which temperature polyimide resin used for the fixing device deforms.

In view of the foregoing, there is a need to prevent overshoot of the heating member even when the main switch of the image forming apparatus is turned off or when power failure or paper jamming occurs, which the known development devices fail to do.

SUMMARY OF THE INVENTION

One illustrative embodiment of the present patent specification provides an image forming apparatus.

The image forming apparatus includes an image carrier on which a toner image is formed, a transfer unit to transfer the toner image from the image carrier onto a recording medium, a fixing device to fix the toner image on the recording medium, and a cooling device to cool a heating member of the fixing device. The fixing device includes a pressure member to apply pressure to the toner image on the recording medium, the heating member to heat the toner image on the recording medium, a heating device to heat the heating member, and a first power supply to supply power to the heating device. The cooling device is supplied with power by a second power supply separate from the first power supply.

Another illustrative embodiment provides the fixing device described above.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
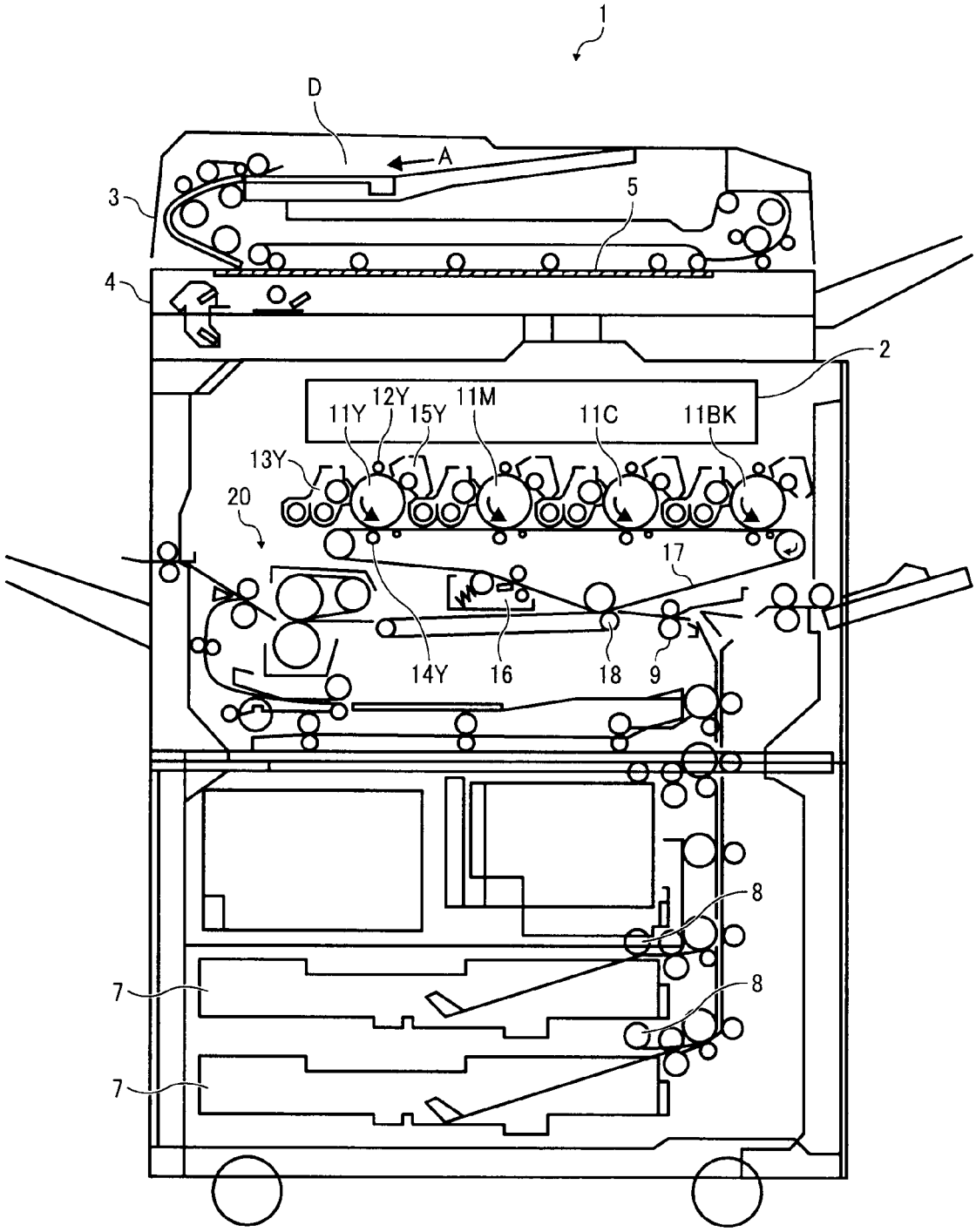
FIG. 1 is an overall configuration diagram illustrating an image forming apparatus of a first embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIG. 1, a first embodiment of the present invention will be described in detail. In the following description, redundant description of the identical or corresponding parts will be simplified or omitted as appropriate.

First Embodiment: With reference to FIG. 1, the configuration and operation of an overall image forming apparatus will be first described. In FIG. 1, the reference numeral 1 denotes the apparatus body of a tandem-type multicolor copier functioning as an image forming apparatus (hereinafter referred to as the image forming apparatus 1). The image forming apparatus 1 includes a writing unit 2 for emitting laser light based on image data, a document feeder 3 for conveying a document D onto a contact glass 5, a document reading unit 4 for reading the image data of the document D conveyed by the document feeder 3, and sheet cassettes 7 for storing sheets P (transfer sheet) of recording media (see FIG. 2) such as paper, overhead projector (OHP) film, and the like.

The image forming apparatus 1 further includes a pair of registration rollers 9 for adjusting the timing of conveying the sheet P, and four image forming units including photoconductor drums 11Y, 11M, 11C, and 11BK, on which yellow (Y), magenta (M), cyan (C), and black (BK) toner images are formed, respectively.

It is to be noted that the subscripts Y, M, C, and BK attached to the end of each reference numeral indicate only that components indicated thereby are used for forming yellow, magenta, cyan, and black images, respectively, and hereinafter may be omitted when color discrimination is not necessary.

Each of the image forming unit includes, in addition to the photoconductor drum 11, a charging unit 12 for charging a surface of the photoconductor drum 11, a development unit 13 for developing an electrostatic latent images formed on the photoconductor drum 11 into a single-color toner image, a primary transfer bias roller 14 for transferring the toner image formed on the photoconductor drum 11 onto an intermediate trans belt 17, and a cleaning unit 15 for collecting any toner remaining on the photoconductor drum 11 after the toner image is transferred therefrom, which is also referred as "untransferred toner" The toner images transferred from the respective photoconductor drums 11 by the primary transfer bias rollers 14 are superimposed one on another on the intermediate transfer belt 17.

The image forming apparatus 1 further includes a belt cleaning unit 16 for cleaning the intermediate transfer belt 17, a secondary transfer bias roller 18 for transferring the toner image from the intermediate transfer belt 17 onto a surface of the sheet P, a fixing device 20 for fixing the unfixed toner image on the sheet P, sheet feeding rollers 8, and so forth. The primary transfer bias rollers 14, the intermediate transfer belt 17, and the secondary transfer bias roller 18 together form a transfer unit to transfer the images formed on the respective photoconductor drums 11 onto the sheet P.

Operations performed in normal multicolor image formation by the image forming apparatus 1 will be described below.

Conveyance rollers of the document feeder 3 first convey the document D from a document table in the direction indicated by arrow A shown in FIG. 1 and place the document D on the contact glass 5 of the document reading unit 4. Then, the document reading unit 4 optically reads the image data of the document D on the contact glass 5.

More specifically, the document reading unit 4 scans the image of the document D on the contact glass 5 while directing light emitted from an illumination lamp thereof to the image. Then, the light reflected by the document D forms an image on a color sensor (not illustrated) via multiple mirrors and lenses. Color image data of the documents D is read by the color sensor for each of color-separated lights of RGB (Red, Green, Blue), and is converted into electrical image signals. Further, on the basis of the color-separated image signals of RGB, processing such as color conversion, color correction, and spatial frequency correction is performed by an image processing unit. Thereby, color image data of yellow, magenta, cyan, and black is obtained.

The image data of the respective colors of yellow, magenta, cyan, and black is then transmitted to the writing unit 2. Then, laser lights (i.e., exposure lights) based on the image data of the respective colors are emitted from the writing unit 2 to the respective surfaces of the corresponding photoconductor drums 11Y, 11M, 11C, and 11BK.

Meanwhile, the four photoconductor drums 11Y, 11M, 11C, and 11BK are rotated counterclockwise in FIG. 1. In each of the four image forming units, the surface of the photoconductor drum 11 is first uniformly charged at a position facing the charging unit 12. That is, a charging process is performed. Thereby, the surface of the photoconductor drum 11 is charged to a given electrical potential. Thereafter, the charged surface of the photoconductor drum 11 reaches a laser light application position.

In the writing unit 2, the laser lights are emitted from four light sources (not illustrated) corresponding to the respective colors according to the image signals. The four laser lights for yellow, magenta, cyan, and black pass through different optical paths, respectively. That is, an exposure process is performed.

The laser light corresponding to the yellow component is applied to the surface of the photoconductor drum 11Y that is the first from the left in the drawing. In this process, the laser light for yellow scans the surface of the photoconductor drum 11Y in the direction of its rotation axis (i.e., main scanning direction), deflected by a polygon mirror (not illustrated) rotating at high speed. Thereby, an electrostatic latent image corresponding to the yellow component is formed on the photoconductor drum 11Y charged by the charging unit 12Y.

Similarly, the laser light for magenta is applied to the surface of the photoconductor drum 11M that is the second from the left in FIG. 1. Thereby, an electrostatic latent image corresponding to the magenta component is formed. Further, the laser light for cyan is applied to the surface of the photoconductor drum 11C that is the third from the left in FIG. 1. Thereby, an electrostatic latent image corresponding to the cyan component is formed. Further, the laser light for black is applied to the surface of the photoconductor drum 11BK that is the first from the right in FIG. 1. Thereby, an electrostatic latent image corresponding to the black component is formed.

Thereafter, the surface of each photoconductor drum 11K carrying the electrostatic latent image reaches a position facing the development unit 13. Then, toner of the corresponding color is supplied from the development unit 13 to the photoconductor drum 11, developing the latent image thereon into a single-color image. That is, a development process is performed.

Thereafter, the surface of each photoconductor drum 11 reaches a position facing the intermediate transfer belt 17, where the primary transfer bias roller 14 contacts an inner circumferential surface of the intermediate transfer belt 17. Then, at the respective positions of the primary transfer bias rollers 14Y, 14M, 14C, and 14BK, the respective multicolor toner images are sequentially transferred from the photoconductor drums 11Y, 11M, 11C, and 11BK and superimposed one on another on an outer circumferential surface of the intermediate transfer belt 17, thus forming a multicolor toner image. That is, a primary transfer process is performed.

Subsequently, the surface of each photoconductor drum 11 reaches a position facing the cleaning units 15, where the cleaning unit 15 removes the untransferred toner remaining on the photoconductor drum 11. That is, a cleaning process is performed.

Thereafter, the surface of each photoconductor drum 11 passes a discharger (not illustrated) that removes the electrical potential from the photoconductor drum 11. Thus, a sequence of image forming processes on the photoconductor drums 11Y, 11M, 11C, and 11BK is completed.

While the above-described processes are performed, the sheet P is conveyed from one of the sheet cassettes 7 to the pair of registration rollers 9. More specifically, the sheet P stored in the sheet cassette 7 is fed therefrom and conveyed by the corresponding sheet feeding roller 8, guided by a conveyance guide, to the registration roller 9.

The intermediate transfer belt 17 carrying the multicolor toner moves clockwise in FIG. 1 to a position facing the secondary transfer bias roller 18, that is, a secondary transfer nip where the intermediate transfer belt 17 contacts the secondary transfer bias roller 18.

Then, timed to coincide with the toner image on the intermediate transfer belt 17, the registration rollers 9 forward the sheet P to the secondary transfer nip, and thus the multicolor toner image carried on the intermediate transfer belt 17 is transferred onto the sheet P. That is, a secondary transfer process is performed.

Thereafter, the outer circumferential surface of the intermediate transfer belt 17 reaches a position facing the belt cleaning unit 16. Then, any toner adhering to the surface of the intermediate transfer belt 17 is collected by the belt cleaning unit 16. Thus, a sequence of transfer processes on the intermediate transfer belt 17 is completed.

Then, the sheet P on which the multicolor (full-color) image is transferred is guided into the fixing device 20 by a conveyance belt. In the fixing device 20, the toner image is fixed on the sheet P in a fixing nip where a fixing belt 21 (shown in FIG. 2) presses against a pressure roller 31 (shown in FIG. 2).

Subsequently, the sheet P is discharged outside the image forming apparatus 1 by discharging rollers, as an output image. Thereby, a sequence of image forming processes is completed.

It is to be noted that the image forming apparatus according to the present embodiment is a high-speed machine whose recording media conveyance speed (i.e., process linear velocity) is set to approximately 352 millimeters per second and whose productivity is set to approximately 75 cycle or copies per minute (CPM) in continuous conveyance of A4-size sheets P in a lateral direction.

Subsequently, with reference to FIG. 2, a configuration and operations of the fixing device 20 provided in the image forming apparatus 1 will be described in detail.

Figure 2:
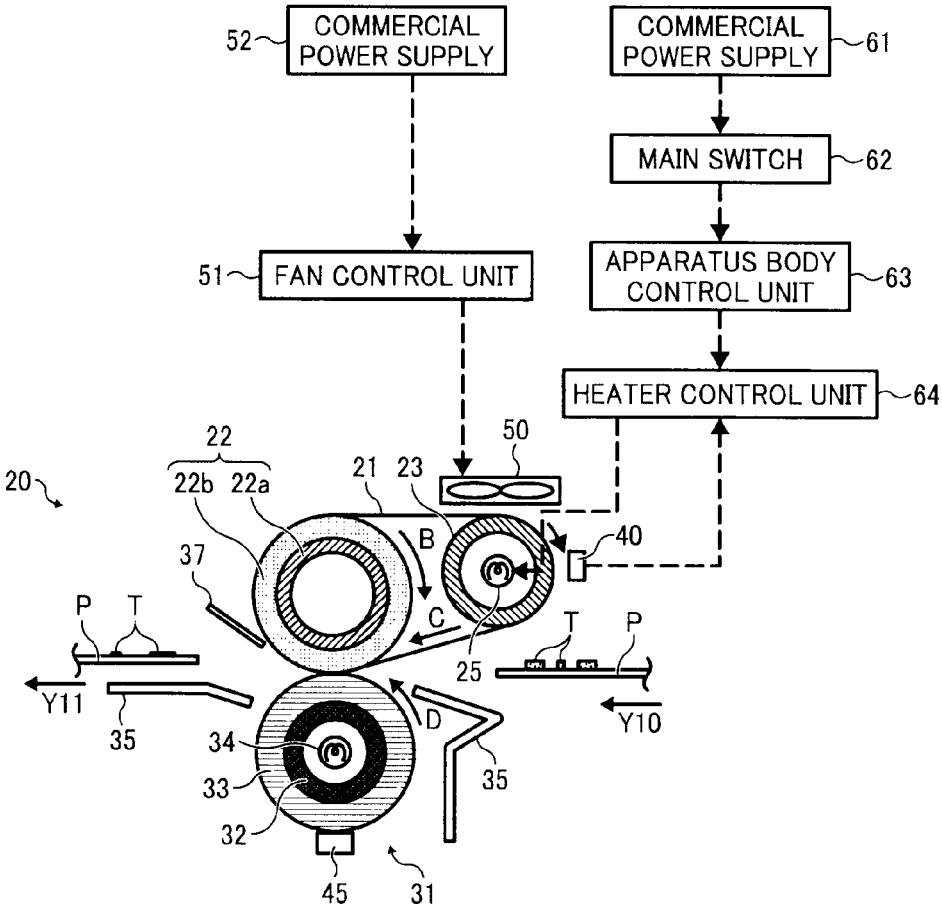
FIG. 2 is a configuration diagram illustrating a fixing device in the image forming apparatus of the first embodiment.

As illustrated in FIG. 2, the fixing device 20 includes a fixing belt 21, a fixing assist roller 22 including a metal core 22*a* and an elastic layer 22*b*, a heating roller 23, a heater 25, a pressure roller 31 serving as a pressure member and includes a metal core 32 and an elastic layer 33, a heater 34, guide plates 35, a separation plate 37, a temperature sensor 40 serving as a temperature detector, a temperature sensor 45, and so forth. In addition, a cooling fans 50 serving as a cooling device is provided to face the heating roller 23. In the present embodiment, the heating roller 23 serves as a heating member.

The image forming apparatus 1 further includes a fan control unit 51, commercial power supplies 52 and 61, a main switch 62, an apparatus body control unit 63, and a heater control unit 64. The commercial power supplies 52 and 61 serve as a second power supply and a first power supply, respectively.

In the present example, the fixing belt 21 is an endless belt having a multilayer structure in which an elastic layer and a release layer are sequentially laminated on a base layer formed of resin such as polyimide. The fixing belt 21 has a circumferential length of approximately 70 millimeters. The elastic layer of the fixing belt 21 is formed of an elastic material such as fluorine rubber, silicone rubber, and foamed silicone rubber. The release layer of the fixing belt 21 is formed of PFA (tetrafluoroethylene-perfluoroalkyl vinyl ether copolymer resin) and so forth. With the release layer provided as a surface layer of the fixing belt 21, the releasability of the fixing belt 21 from toner T (toner image) is ensured, that is, the toner T does not adhere to the fixing belt 21. The fixing belt 21 is stretched over and supported by two roller members, the fixing assist roller 22 and the heating roller 23, and is rotated in a direction indicated by arrow C in FIG. 2. Because the fixing belt 21 having a relatively low thermal capacity is used as a fixing member, the temperature increasing characteristic of the fixing device 20 is improved.

The fixing assist roller 22 is a roller having an outer diameter of approximately 52 millimeters and includes the metal core 22*a* formed of a material such as SUS304 and covered by the elastic layer 22*b* formed of a foamed material such as foamed silicone rubber. The fixing assist roller 22 contacts the pressure roller 31 serving as the pressure member via the fixing belt 21. Thus, the nip portion is formed therebetween. With the elastic layer 22*b* formed of the foamed material, a nip width (i.e., nip amount) of the nip portion where the fixing assist roller 22 presses against the pressure roller 31 via the fixing belt 21 can increase, and the transfer of the heat from the fixing belt 21 to the fixing assist roller 22 is suppressed. The fixing assist roller 22 is rotated clockwise in FIG. 2, which is a direction indicated by arrow B shown in FIG. 2.

The heating roller 23 is a hollow roller (i.e., cylindrical body) formed of metal such as aluminum, stainless steel, or the like. The heater 25 serving as a heat source is fixed inside the cylindrical body.

By configuring the heating roller 23 to have a thickness of approximately 1 millimeter or less, the thermal capacity of the heating roller 23 is reduced, and the temperature increasing characteristic of the fixing device 20 is improved. That is, the temperature raise time is reduced. The heating roller 23 in the present embodiment is formed of aluminum and has a thickness of approximately 0.6 millimeters and an outer diameter of approximately 35 millimeters.

The heater 25 provided inside the heating roller 23 is a halogen heater with both end portions thereof fixed to side plates (not illustrated) of the fixing device 20. When the main switch 62 of the image forming apparatus 1 is turned on, power is supplied from the commercial power supply 61 (first power supply) to the heater 25, controlled by the apparatus body control unit (hereinafter "controller") 63 of the image forming apparatus 1 and the heater control unit 64. Then, the heating roller 23 is heated by radiant heat from the heater 25, the output of which is controlled by the heater control unit 64. Further, the toner T of the toner image on the sheet P is receives heat from a surface of the fixing belt 21 heated by the heating roller 23.

Thus, the fixing belt 21 heated by the heating roller 23 (heating member) applies heat to the image on the sheet. That is, the fixing belt 21 is indirectly heated by the heater 25 that receives power from the commercial power supply 61.

The output of the heater 25 is controlled based on the surface temperature of the fixing belt 21 detected by the temperature sensor 40 that may be a thermopile, for example. The temperature sensor 40 serving as a temperature detector faces the surface of the fixing belt 21 in a non-contact manner. More specifically, the heater 25 receives an alternating voltage during an activation time determined based on the detection result by the temperature sensor 40 serving as the temperature detector. With the above-described output control of the heater 25, the temperature of the fixing belt 21 (i.e., fixing temperature) can be adjusted to a desired temperature (i.e., control target temperature).

In the present embodiment, a heater having a rated wattage of approximately 1200 watts is used as the heater 25. With the total wattage of the heater 25 thus increased, the start-up time (i.e., warm-up time) of the fixing device 20 can be reduced.

Further, the pressure roller 31 serving as the pressure member is mainly formed by the metal core 32 and the elastic layer 33 formed over an outer circumferential surface of the metal core 32 with an adhesive layer interposed therebetween. The elastic layer 33 of the pressure roller 31 is formed of a material such as foamed silicone rubber, fluorine rubber, and silicone rubber. It is also possible to provide a thin release layer formed of PFA and so forth as a surface layer on the elastic layer 33.

The pressure roller 31 presses against the fixing assist roller 22 via the fixing belt 21, pressed by a pressure mechanism (not illustrated). Thereby, a desired amount of nip portion is formed therebetween. The above-described pressure mechanism is configured to be able to release or adjust the pressure to the pressure roller 31.

In the present embodiment, the heater 34 is provided inside the pressure roller 31 to improve the heating efficiency of the fixing belt 21. Further, the output of the heater 34 is controlled based on results of detection by the temperature sensor 45 that detects the surface temperature of the pressure roller 31.

In the present embodiment, the controlled temperature of the heating roller 23 and that of the pressure roller 31 in the standby state (i.e., non-operational state) are set to be approximately 170 degrees Celsius and approximately 150 degrees Celsius, respectively. Further, the set temperature of the heating roller 23 and that of the pressure roller 31 in the sheet passing time (i.e., operational state) are approximately 165 degrees Celsius and approximately 120 degrees Celsius, respectively.

As illustrated in FIG. 2, the guide plates 35 for guiding the conveyance of the sheet P are provided on an entrance side and an exit side of the contact portion (i.e., nip portion) between the fixing belt 21 and the pressure roller 31. The guide plates 35 are fixed to the side plates of the fixing device 20.

Further, the separation plate 37 is provided in the vicinity of the exit of the nip portion at a position facing the outer circumferential surface of the fixing belt 21. With the separation plate 37 thus provided, it is possible to reduce a defect that the sheet P winds around the fixing belt 21 along with the movement of the fixing belt 21 after the fixing process.

The fixing device 20 configured as described above operates as follows. When the main switch 62 of the image forming apparatus 1 is turned on, the commercial power supply 61 serving as the first power supply applies (i.e., supplies) the alternating voltage to the heater 25. At the same time, the fixing belt 21, the fixing assist roller 22 and the heating roller 23 provided inside the fixing belt 21, and the pressure roller 31 start rotating in the directions indicated by respective arrows C, B, and D shown in FIG. 2. The commercial power supply 61 also serves as a power supply source for the other devices than the fixing device 20 provided in the image forming apparatus 1, e.g., the image forming unit, the sheet feeding unit, and the conveyance unit.

Thereafter, the sheet P is fed and conveyed from one of the sheet cassettes 7, and the single-color toner images formed on the respective photoconductor drums 11Y, 11M, 11C, and 11BK are transferred via the intermediate transfer belt 17 onto the sheet P as unfixed image. The sheet P carrying the unfixed toner image formed by the toner T is conveyed in the direction indicated by arrow Y10 in FIG. 2, and is inserted into the nip portion where the pressure roller 31 presses against the fixing belt 21. Then, the toner image formed by the toner T is fixed on the surface of the sheet P with the heat applied by the fixing belt 21 and the pressure between the pressure roller 31 and the fixing assist roller 22 via the fixing belt 21. Thereafter, the sheet P sent out from the nip portion by the rotating fixing belt 21 and pressure roller 31 is conveyed in the direction indicated by arrow Y11.

Distinctive features and operations of the fixing device 20 in the present embodiment will be described in detail below.

In FIG. 2, the cooling fans 50 as a cooling device for cooling the heating roller 23 are provided at respective positions facing the heating roller 23 across the fixing belt 21. Although illustration is omitted, three cooling fans 50 are provided in a row facing a center portion and both end portions of the heating roller 23 in the longitudinal direction thereof, which is a direction perpendicular to the surface of the paper on which FIG. 2 is drawn.

The cooling fans 50 operate with power supplied from the commercial power supply 52 serving as a second power supply. That is, the cooling fans 50 are supplied with power from the separate commercial power supply 52 from the commercial power supply 61, serving as the first power supply, that is turned on and off by the main switch 62 of the image forming apparatus 1. In addition, the cooling fans 50 are controlled by the fan control unit 51 to cool the heating roller 23 via the fixing belt 21 at predetermined timing.

Figure 3:
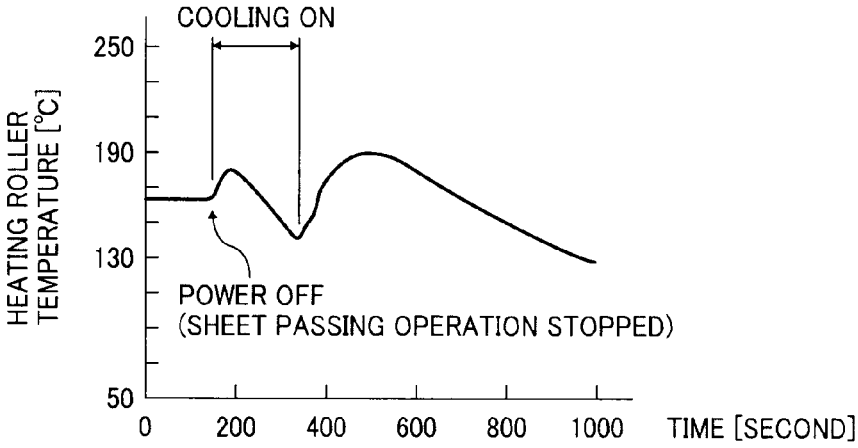
FIG. 3 is a graph illustrating the temperature fluctuation of a heating roller of the fixing device after the turn-off of a main switch of the image forming apparatus.

More specifically, as illustrated in FIG. 3, the cooling fans 50 operates to cool the heating roller 23 for approximately 200 seconds, for example, after the turn-off of the main switch 62 of the image forming apparatus 1. That is, upon turn-off of the main switch 62 of the image forming apparatus 1, power is supplied from the commercial power supply 52, and the cooling fans 50 starts operating. Then, the cooling fan 50 stops operating when approximately 200 seconds are elapsed after the turn-off of the main switch 62.

As for the timing of starting the cooling fans 50, starting the cooling fans 50 is not triggered by an OFF signal of the main switch 62. The fan control unit 51 checks whether or not a rotary member (e.g., heating roller 23) in the fixing device 20 has stopped rotating, and a detection signal indicating cessation of the rotation of the rotary member triggers the start of the cooling fans 50. With this configuration, the cooling fans 50 can cool the heating roller 23 for a predetermined or given time period also when the main switch 62 is forcefully turned off during the printing operation and when the conveyance of the sheet P is stopped (e.g., the sheet P is jammed) during the printing operation, in addition to when the main switch 62 is turned off immediately after the completion of the printing operation. Accordingly, overshoot, that is, an excessive increase in temperature, of the heating roller 23 can be reliably prevented.

As illustrated in FIG. 3, the temperature of the heating roller 23 increases after the sheet passing operation is stopped. However, the degree of the increase in temperature is substantially reduced due to the cooling by the cooling fans 50. More specifically, the increase in temperature of the heating roller 23 after the cessation of the sheet passing operation is approximately 20 degrees Celsius or less (i.e., the temperature of the heating roller 23 is approximately 190 degrees Celsius or less) during and after the operation of the cooling fans 50. Therefore, it is possible to reliably prevent thermal damage to the heating roller 23 and to the fixing belt 21 stretched over the heating roller 23.

Descriptions will be given below of fluctuation of the temperature of a heating roller after a main switch is turned off in two comparative image forming apparatuses A and B in which cooling fans to cool the heating roller are not provided with reference to FIG. 4.

Figure 4:
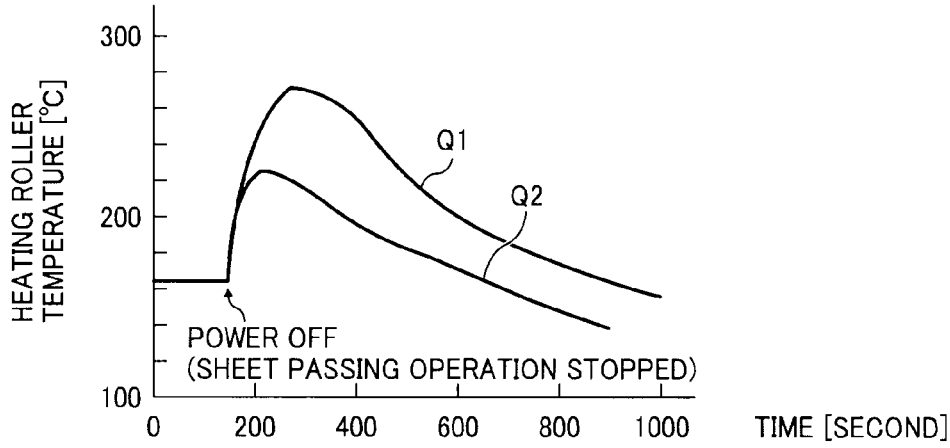
FIG. 4 is graphs each illustrating the temperature fluctuation of the heating roller after the turn-off of a main switch of an existing image forming apparatus.

In FIG. 4, a graph Q1 is the temperature fluctuation of the heating roller in the comparative image forming apparatus A whose printing speed is approximately 75 CPM, and a graph Q2 is that of the comparative image forming apparatus B whose printing speed is approximately 40 CPM. The above-described effect of the present embodiment can be confirmed from the comparison between the graphs in FIGS. 3 and 4.

It is preferable to stop the cooling fans 50 upon start of the operation of the fixing device 20, i.e., upon start of the printing operation. More specifically, the cooling fans 50 are deactivated when the fan control unit 51 detects that the rotary member (e.g., the heating roller 23) in the fixing device 20 has started rotating. With this configuration, the heating roller 23 is not cooled by the cooling fans 50 during the printing operation. Accordingly, it is possible to prevent a decrease in the heating efficiency of the heating roller 23 and the fixing belt 21 during the printing operation.

As described above, in the present embodiment, the cooling fans 50 for cooling the heating roller 23 are operated by the commercial power supply 52 different from the commercial power supply 61 which operates the fixing device 20. Therefore, it is possible to suppress overshoot of the heating roller 23 in situations such as when the main switch 62 of the image forming apparatus 1 is turned off during or immediately after the printing operation, and when the sheet P is jammed during the printing operation.

Descriptions will be made below of another embodiment with reference to FIG. 5.

Figure 5:
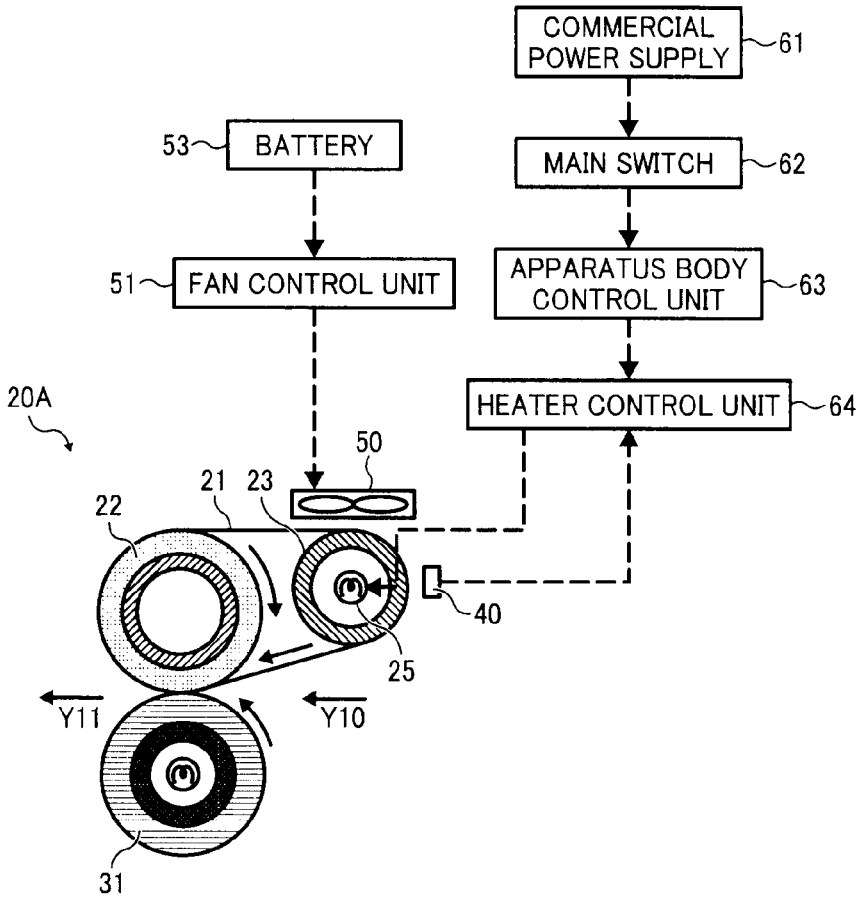
FIG. 5 is a configuration diagram illustrating a fixing device of a second embodiment of the present invention.

FIG. 5 illustrates a configuration of a fixing device 20A in another embodiment and corresponds to FIG. 2 illustrating the fixing device 20 according to above-described embodiment. In the present embodiment, a battery 53 is used as the second power supply for operating cooling fans 50. In this regard, the present embodiment is different from the previous embodiment shown in FIG. 2, which uses the commercial power supply 52 as the second power supply for operating the cooling fans 50.

Similarly to the fixing device 20 shown in FIG. 2, the fixing device 20A shown in FIG. 5 also include a fixing belt 21, a fixing assist roller 22, a heating roller 23, a heater 25, a pressure roller 31, the cooling fans 50 (i.e., cooling device), a temperature sensor 40 (i.e., temperature detector), and so forth. Further, also in the present embodiment, the cooling fans 50 operate with power supplied from the second power supply (battery 53) different from the commercial power supply 61 serving as the first power supply and cool the heating roller 23 at predetermined timing.

The fixing device 20A uses, as the second power supply (i.e., a separate power supply), the replaceable battery 53. Further, when the cessation of the rotation of the rotary member in the fixing device 20A (e.g., the heating roller 23) is detected, the cooling fans 50 operate for approximately 200 seconds with power supplied from the battery 53. Thereby, the heating roller 23 is cooled.

In particular, in the present embodiment using the battery 53 as the second power supply, the cooling fans 50 can be independently operated, even when the power supply to the image forming apparatus 1 is stopped due to a power failure during or immediately after the printing operation.

As described above, in the embodiment shown in FIG. 5, the cooling fans 50 (i.e., cooling device) for cooling the heating roller 23 (i.e., heating member) are operated by the battery 53 different from the commercial power supply 61 which operates the fixing device 20A. Accordingly, overshoot of the heating roller 23 can be suppressed in situations such as when the main switch 62 of the image forming apparatus 1 is turned off during or immediately after the printing operation, when the sheet P is jammed during the printing operation, and when the power supply to the image forming apparatus 1 is stopped due to a power failure during or immediately after the printing operation.

Figure 6:
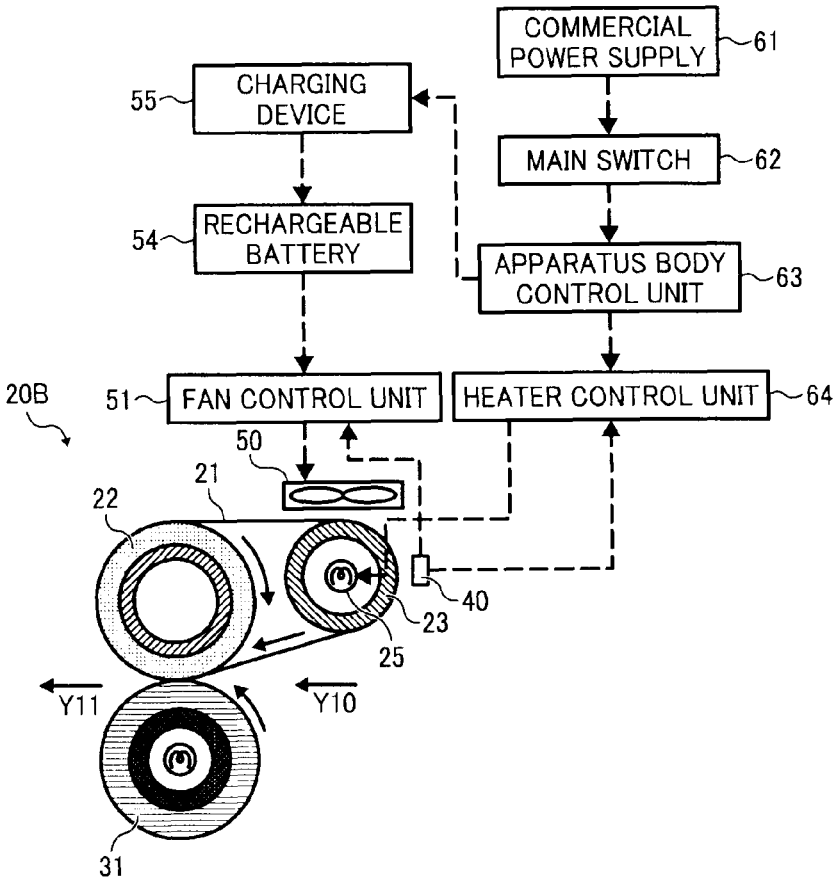
FIG. 6 is a configuration diagram illustrating a fixing device of a third embodiment of the present invention.

Descriptions will be made below of yet another embodiment of the present invention with reference to FIGS. 6 and 7. FIG. 6 illustrates a configuration of a fixing device 20B in another embodiment and corresponds to FIG. 2 illustrating the fixing device 20 in the previous embodiment described above.

In the fixing device 20B shown in FIG. 6, a rechargeable battery 54 is used as a second power supply for operating cooling fans 50, and the operation of the cooling fans 50 is started and stopped based of the result of detection by a temperature sensor 40. In these regards, the embodiment shown in FIG. 6 is different from the above-described embodiment shown in FIG. 2.

Similarly to the fixing device 20 of the first embodiment described above, the fixing device 20B shown in FIG. 6 also include a fixing belt 21, a fixing assist roller 22, a heating roller 23 (i.e., heating member), a heater 25, a pressure roller 31, the cooling fans 50 (i.e., cooling device), the temperature sensor 40 (i.e., temperature detector), and so forth. Further, the cooling fans 50 operate with power supplied from the second power supply different from the commercial power supply 61 serving as the first power supply and cool the heating roller 23 at predetermined timing.

The fixing device 20B shown in FIG. 6 uses the rechargeable battery 54 provided in the image forming apparatus 1 as the second power supply (i.e., a separate power supply). The rechargeable battery 54 is rechargeable by the commercial power supply 61. More specifically, when the electricity stored therein is reduced, the rechargeable battery 54 is charged with power from the commercial power supply 61 via a charging device 55.

Further, when it is detected that a rotary member in the fixing device 20B (e.g., the heating roller 23) has stopped rotating, the cooling fans 50 operate with power supplied from the rechargeable battery 54. Thereby, the heating roller 23 is cooled.

In particular, in the embodiment shown in FIG. 6 using the rechargeable battery 54 as the second power supply, the cooling fans 50 can be independently operated, even when the power supply to the image forming apparatus 1 is stopped due to a power failure during or immediately after the printing operation. Further, unlike the configuration shown in FIG. 5 using a standard replaceable battery as the second power supply, the configuration shown in FIG. 6 can dispense with replacement of the battery.

Further, in the embodiment shown in FIG. 6, the temperature sensor 40 is provided as a temperature detector for indirectly detecting the temperature of the heating roller 23 (i.e., heating member). Then, as illustrated in FIG. 7, the cooling fans 50 are activated when the temperature detected by the temperature sensor 40 exceeds a predetermined or given temperature. More specifically, when the surface temperature of the heating roller 23 exceeds approximately 190 degrees Celsius, the cooling fans 50 are operated with power supplied from the rechargeable battery 54. With this configuration, it is possible to effectively operate the cooling fans 50 only when overshoot (i.e., excessive increase in temperature) of the heating roller 23 is about to occur.

Figure 7:
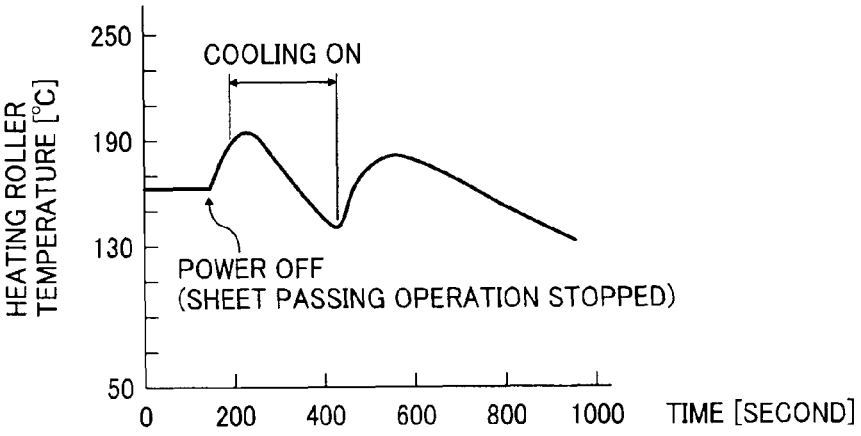
FIG. 7 is a graph illustrating the temperature fluctuation of a heating roller of the fixing device in FIG. 6 after the turn-off of a main switch of an image forming apparatus.

Further, in the present embodiment, the cooling fans 50 are deactivated when the temperature detected by the temperature sensor 40 falls below a predetermined or given temperature, as illustrated in FIG. 7. More specifically, when the surface temperature of the heating roller 23 falls below approximately 140 degrees Celsius, power supplied from the rechargeable battery 54 to the cooling fans 50 is stopped, thereby deactivating the cooling fans 50. With this configuration, it is possible to reliably cool the heating roller 23 down to a predetermined or given temperature when overshoot of the heating roller 23 is about to occur, irrespective of the usage state of the image forming apparatus.

In the present embodiment, the temperature sensor 40 is provided to face the heating roller 23 across the fixing belt 21 to indirectly detect the temperature of the heating roller 23. Alternatively, the temperature sensor 40 may be provided to directly face the heating roller 23 to directly detect the temperature of the heating roller 23.

As described above, in the fixing device 20B, the cooling fans 50 (i.e., cooling device) for cooling the heating roller 23 (i.e., heating member) are operated by the rechargeable battery 54 different from the commercial power supply 61 which operates the fixing device 20B. Accordingly, it is possible to suppress overshoot of the heating roller 23 in situations such as when the main switch 62 of the image forming apparatus 1 is turned off during or immediately after the printing operation, when the sheet P is jammed during the printing operation, and when the power supply to the image forming apparatus 1 is stopped due to a power failure occurring during or immediately after the printing operation.

It is to be noted that, although the pressure roller 31 is used as the pressure member in the respective embodiments described above, alternatively, a pressure belt or a pressure pad may be used as the pressure member. Also in such a case, effects similar to those attained in the respective embodiments described above can be obtained. The fixing belt can be wound around the heating roller disposed facing the pressure roller without using the fixing assist roller.

Further, although the fixing belt 21 is used in the respective embodiments described above, needless to say, it is possible to apply the present invention to a fixing device using a fixing roller as the fixing member, or a fixing device in which the fixing belt is not used and the pressure member presses against the heating member so that the heating member directly heats the image on the sheet.

Although the heating member is heated with radiant heat by the heater 25 in the respective embodiments described above, it is, of course, possible to adopt a fixing device which heats the heating member by an electromagnetic induction heating unit.

Also in such cases, effects similar to those attained in the respective embodiments described above can be obtained.

The cooling fans 50 can be provided in the fixing device, or alternatively, the cooling fans 50 may be provided in the image forming apparatus 1 outside the fixing device.

Moreover, the cooling device is not limited to the cooling fans 50. Alternatively, for example, it is also possible to use a heat pipe or the like that can contact the heating member and be disengaged therefrom. Also in such a case, effects similar to those attained in the respective embodiments described above can be obtained by engaging and disengaging the heat pipe from the heating member, which is performed with power from the second power supply.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape thereof, are not limited the embodiments and thus may be preferably set. It is therefore to be understood that within the scope of the appended claims, the disclosure of this patent specification may be practiced otherwise than as specifically described herein.

What is claimed is:

1. An image forming apparatus comprising:

an image forming apparatus controller;

an image carrier on which a toner image is formed;

a transfer unit to transfer the toner image from the image carrier onto a recording medium;

a fixing device to fix the toner image on the recording medium, the fixing device comprising:

a pressure member to apply pressure to the toner image on the recording medium, a heating member to heat the toner image on the recording medium, a heating device to heat the heating member, a main switch to disconnect power to the image forming apparatus controller and the heating device; and a cooling device to cool the heating member of the fixing device, wherein when the main switch disconnects power to the image forming apparatus controller and the heating device, the main switch does not disconnect power to the cooling device.

2. The image forming apparatus according to claim 1, further comprising:

a replaceable battery connected to the cooling device which supplies power to the cooling device.

3. The image forming apparatus according to claim 1, further comprising:

a rechargeable battery which supplies power to the cooling device and is rechargeable by power passing through the main switch.

4. The image forming apparatus according to claim 1, further comprising:

a temperature detector, connected to a fan controller, to detect a temperature of the heating member, wherein the cooling device is activated by the fan controller when the temperature detected by the temperature detector exceeds a predetermined temperature.

5. The image forming apparatus according to claim 1, further comprising:

a temperature detector, connected to a fan controller, to detect a temperature of the heating member, wherein the cooling device is deactivated by the fan controller when the temperature detected by the temperature detector falls below a predetermined temperature.

6. The image forming apparatus according to claim 1, wherein the cooling device is deactivated by a fan controller when the fixing device starts operating.

7. The image forming apparatus according to claim 1, wherein the cooling device includes a cooling fan disposed facing the heating member.

8. The image forming apparatus according to claim 1, further comprising:

a fixing assist roller; and a fixing belt stretched over the fixing assist roller and the heating member, wherein the pressure member presses against the fixing assist roller via the fixing belt to form a nip portion therebetween through which the recording medium is conveyed.

9. The image forming apparatus according to claim 8, wherein the heating member is a heating roller, and the heating device is a heater that is disposed within the heating roller and electrically connected to the first power supply.

10. The image forming apparatus according to claim 1, further comprising:

a power supply which supplies power to the heating device though the main switch.

* * * * *